US005373314A

United States Patent [19]

Everett et al.

[11] Patent Number: 5,373,314

[45] Date of Patent: Dec. 13, 1994

[54] INK JET PRINT HEAD

[75] Inventors: Mickey H. Everett, Spring; David B. Wallace, Dallas; Donald J. Hayes, Plano, all of Tex.

[73] Assignee: Compaq Computer Corporation, Houston, Tex.

[21] Appl. No.: 936,136

[22] Filed: Aug. 27, 1992

[51] Int. Cl.[5] ..... B41J 2/045

[52] U.S. Cl. ..... 347/71

[58] Field of Search ..... 346/140 R; 310/330–333; 347/69, 68, 71; B41J 2/045, 3/04

[56] References Cited

U.S. PATENT DOCUMENTS

| | | | |
|---|---|---|---|
| 3,857,049 | 12/1974 | Zoltan | 310/8.1 |
| 3,946,398 | 3/1976 | Kyser et al. | 346/1 |
| 4,536,097 | 8/1985 | Nilsson | 400/126 |
| 4,584,590 | 4/1986 | Fischbeck et al. | 346/140 R |
| 4,825,227 | 4/1989 | Fischbeck et al. | 346/1.1 |
| 4,879,568 | 11/1989 | Bartky et al. | 346/140 R |
| 4,887,100 | 12/1989 | Michaelis et al. | 346/140 R |
| 5,016,028 | 5/1991 | Temple | 346/140 R |
| 5,235,352 | 8/1993 | Pies et al. | 346/140 R |

FOREIGN PATENT DOCUMENTS

| | | | |
|---|---|---|---|
| 0479327 | 4/1992 | European Pat. Off. | B41J 2/045 |
| 0516284 | 12/1992 | European Pat. Off. | B41J 2/045 |
| 3-295658 | 12/1991 | Japan | B41J 2/045 |
| 4-148934 | 5/1992 | Japan | B41J 2/045 |

OTHER PUBLICATIONS

Patent Abstracts of Japan, vol. 16, No. 573 (M-1344) 14 Dec. 1992.

Patent Abstracts of Japan, vol. 17, No. 099 (M-1373) 26 Feb. 1992.

*Primary Examiner*—Benjamin R. Fuller
*Assistant Examiner*—Alrick Bobb
*Attorney, Agent, or Firm*—Konneker Bush Hitt & Chwang

[57] ABSTRACT

A length mode drop on demand type ink jet print head includes a lower body portion formed of an active piezoelectric material and an upper body formed from an inactive material. The lower body portion, which includes a plurality of longitudinally extending projections, is poled in a first direction generally orthogonal to both its longitudinal and vertical axes. The upper body portion also includes a plurality of longitudinally extending projections. The lower and upper body portions are mated such that the lower and upper body projections are spaced interdigitally with each other. By mating the lower and upper body portions in this manner, a plurality of ink-carrying channels are formed. The ink jet print head further includes a controller for selectively applying an electric field across each of the lower body projections in the poling direction. When an electric field is applied across one of the lower body projections in this fashion, the projection imparts a pressure pulse to the ink-carrying channel associated therewith. The active lower body portion may be replaced with an inactive lower body portion, an active intermediate body portion which includes a plurality of longitudinally extending projections, each having a strip of conductive material along the top surface thereof, and a layer of conductive material mounting the lower and intermediate body portions together. Here, the intermediate body portion would be poled in its vertical axis and the electric field would be applied between the conductive strip and layer.

26 Claims, 5 Drawing Sheets

INK JET PRINT HEAD

BACKGROUND OF THE INVENTION

1. Field of the Invention

The invention relates to ink jet printing techniques and, more particularly, to a length mode, large array, high density, drop on demand type ink jet print head for use in ink jet printing applications.

2. Description of Related Art

Printers provide a means of outputting a permanent record in human readable form. Typically, a printing technique may be categorized as either impact printing or non-impact printing. In impact printing, an image is formed by striking an inked ribbon placed near the surface of the paper. Impact printing techniques may be further characterized as either formed-character printing or matrix printing. In formed-character printing, the element which strikes the ribbon to produce the image consists of a raised mirror image of the desired character. In matrix printing, the character is formed as a series of closely spaced dots which are produced by striking a provided wire or wires against the ribbon. Here, characters are formed as a series of closely spaced dots produced by striking the provided wire or wires against the ribbon. By selectively striking the provided wires, any character representable by a matrix of dots can be produced.

Non-impact printing is often preferred over impact printing in view of its tendency to provide higher printing speeds as well as its better suitability for printing graphics and half-tone images. Non-impact printing techniques include matrix, electrostatic and electrophotographic type printing techniques. In matrix type printing, wires are selectively heated by electrical pulses and the heat thereby generated causes a mark to appear on a sheet of paper, usually specially treated paper. In electrostatic type printing, an electric arc between the printing element and the conductive paper removes an opaque coating on the paper to expose a sublayer of a contrasting color. Finally, in electrophotographic printing, a photoconductive material is selectively charged utilizing a light source such as a laser. A powder toner is attracted to the charged regions and, when placed in contact with a sheet of paper, transfers to the paper's surface. The toner is then subjected to heat which fuses it to the paper.

Another form of non-impact printing is generally classified as ink jet printing. Ink jet printing systems use the ejection of tiny droplets of ink to produce an image. The devices produce highly reproducible and controllable droplets so that a droplet may be printed at a location specified by digitally stored image data. Most ink jet printing systems commercially available may be generally classified as either a "continuous jet" type ink jet printing system where droplets are continuously ejected from the print head and either directed to or away from the paper depending on the desired image to be produced or as a "drop on demand" type ink jet printing system where droplets are ejected from the print head in response to a specific command related to the image to be produced.

In a continuous jet type ink jet printer, a pump supplies ink to a nozzle assembly where the pumping pressure forces the ink to be ejected therefrom in a continuous stream. The nozzle assembly includes a piezo crystal continuously driven by an electrical voltage, thereby creating pressure disturbances that cause the continuous stream of ink ejected therefrom to break up into uniform droplets of ink. The droplets acquire an electrostatic charge due to the presence of an electrostatic field established close to the ejection orifice. Using high voltage deflection plates, the trajectory of selected ones of the electrostatically charged droplets can be controlled to hit a desired spot on a sheet of paper. The high voltage deflection plates can also deflect unselected ones of the electrostatically charged droplets away from the sheet of paper and into a reservoir for recycling purposes. Due to the small size of the droplets and the precise trajectory control, the quality of continuous jet type ink jet printing systems can approach that of formed-character impact printing systems. However, one drawback to continuous jet type ink jet printing systems is that fluid must be jetting even when little or no printing is required. This requirement degrades the ink and decreases reliability of the printing system.

Due to this drawback, there has been increased interest in those printing systems in which droplets are ejected from the print head by electromechanically induced pressure waves. In this type of printing system, a volumetric change in the fluid is induced by the application of a voltage pulse to a piezoelectric material which is directly or indirectly coupled to the fluid. This volumetric change causes pressure/velocity transients to occur in the fluid, thereby causing the ejection of a droplet therefrom. Since the voltage is applied only when a droplet is desired, these types of ink jet printing systems are referred to as "drop on demand" type ink jet printing systems.

A typical drop on demand type ink jet printing system is disclosed in U.S. Pat. No. 3,946,598 to Kyser et al. In Kyser et al., a pressure plate formed from two transversely expandable piezoelectric plates is utilized as the upper wall of an ink-carrying pressure chamber. By applying a voltage across the piezoelectric plates, the pressure plate flexes inwardly into the pressure chamber, thereby causing a fluid displacing volumetric change within the chamber.

Another typical drop on demand type ink let printing system is disclosed in U.S. Pat. No. 4,536,097 to Nilsson. In Nilsson, an ink jet channel matrix is formed using a series of piezoelectric strips disposed in spaced parallel relationship with each other and covered by a plate on both sides. One plate is constructed of a conductive material and forms a shared electrode for all of the strips of piezoelectric material. On the other side, electrical contacts are used to electrically connect channel defining pairs of the strips of piezoelectric material. When a voltage is applied to the two strips of piezoelectric material which define a channel, the strips become narrower and higher such that the enclosed cross-sectional area of the channel is enlarged and ink is drawn into the channel. When the voltage is removed, the strips return to their original shape, thereby reducing the channel volume and ejecting ink therefrom. Other, albeit shear mode type, ink jet printing systems which utilize separate sections of a piezoelectric material to form individual actuator walls for an ink-carrying channel are disclosed in U.S. Pat. Nos. 4,879,568 to Bartky et al. and 4,887,100 to Michaelis et al.

The major drawback to drop on demand type ink jet printing systems such as those disclosed in Kyser et al., Nilsson, Bartky et al. and Michaelis et al. is the difficulty in manufacturing an ink jet print head, particularly a large array or high density ink jet print heads, in such configurations. Each of these configurations utilize a separate actuator piece for each channel. Accordingly, to construct such a print head, a large number of individual parts must be used to assemble the channel array. Electrical contacts are either separately attached to each actuator before assembly or attached after the channel array is assembled, either of which is a very time consuming operation. Due to the large number of steps required to assemble such a print head, the manufacture of such a print head with a nozzle density greater than 100 nozzles per inch has proven difficult in practice.

Shear mode type piezoelectric transducers which are common to multiple ink-carrying channels in a drop on demand type ink jet printing system are disclosed in U.S. Pat. Nos. 4,584,590 and 4,825,227 to Fischbeck et al. In both of the Fischbeck et al. patents, a series of open ended parallel ink pressure chambers are covered with a sheet of a piezoelectric material along their roofs. Electrodes are provided on opposite sides of the sheet of piezoelectric material such that positive electrodes are positioned above the vertical walls separating pressure chambers and negative electrodes are positioned over the chamber itself. When an electric field is applied across the electrodes, the piezoelectric material, which is poled in a direction normal to the electric field, distorts in a shear mode configuration to compress the ink pressure chamber. In these configurations, however, three or more electrodes are required for each channel. Furthermore, as respective deflections at various locations along a single sheet of piezoelectric material is used to activate the various channels included in the array, adjacent channels must be spaced a considerable distance apart or use a separate restraining mechanism to prevent cross-talk between adjacent channels. For these reason, the Fischbeck et al. configurations are not particularly well suited for large array or high density applications.

By allowing the manufacture of large array, high density, drop on demand type ink jet print heads, the present invention will enable the design and manufacture of various printing systems, including printers, facsimile machines, copiers and others, in both single multiple color applications, with higher performance characteristics and at lower cost, than many existing printing systems.

SUMMARY OF THE INVENTION

In one embodiment, the present invention is of a length mode, drop on demand type ink jet print head which includes a lower body portion formed of an active piezoelectric material and an upper body formed from an inactive material. The lower body portion, which includes an upper side surface and a plurality of generally parallel spaced projections projecting vertically from the upper side surface and extending longitudinally along the lower body portion, is poled in a first direction generally orthogonal to both its longitudinal axis and the vertical extension of the projections. The upper body portion includes a lower side surface and a plurality of generally parallel spaced projections projecting vertically from the lower side surface and extending longitudinally along the upper body portion. The lower and upper body portions are then mated so that the projections extending from the lower body portion are spaced interdigitally with the projections of the projections extending from the upper body portion. By mating the lower and upper body portions in this manner, a plurality of ink-carrying channels are formed. The ink jet print head further includes means for selectively applying an electric field across each of the projections of the lower body portion and in the first direction. When an electric field is applied across one of the projections of the lower body portion, the projection moves, thus imparting a pressure pulse to one of the ink-carrying channels.

In one aspect of this embodiment of the invention, each lower body projection is inserted between a pair of upper body projections such that the ink-carrying channel formed thereby is defined by the top surface of the lower body projection, portions of sidewalls of the pair of upper body projections and that portion of the lower side surface between the pair of upper body projections and, in another aspect of this embodiment of the invention, each lower body projection is inserted between second, narrower, sections of a pair of upper body projections until a top surface of the lower body projection mates with notched sections of the upper body projections such that the ink-carrying channel formed thereby is defined by the top surface of the lower body projection, first, wider, sections of the pair of upper body projections and that portion of the lower side surface between the pair of upper body projections. In further aspects of this embodiment of the invention, a layer of conductive material is mounted to each sidewall of the lower body projections. A voltage drop applied therebetween causes that projection to impart the aforementioned pressure pulse. The voltage drop may be applied by a controller having conductive leads electrically connected to the layers of conductive material.

In another embodiment, the present invention is of a length mode, drop on demand type ink jet print head which includes a lower body portion formed of an active piezoelectric material and an upper body formed from an inactive material. The lower body portion, which includes an upper side surface and first and second generally parallel spaced projections projecting vertically from the upper side surface, extending longitudinally along the lower body portion and having a layer of conductive material mounted along each sidewall thereof, is poled in a first direction generally orthogonal to both its longitudinal axis and the vertical extension of the projections. The upper body portion includes a lower side surface and first, second and third generally parallel spaced projections projecting vertically from the lower side surface and extending longitudinally along the upper body portion. The lower and upper body portions are then mated so that the first lower body projection is inserted between the first and second upper body projections to form a first ink-carrying channel defined by a top surface of the first lower body projection, a portion of the second sidewall surface of the first upper body projection, a portion of the first sidewall surface of the second upper body projection and that portion of the lower side surface therebetween and the second lower body projection is inserted between the second and third upper body projections to form a second ink-carrying channel defined by a top surface of the second lower body projection, a portion of the second sidewall surface of the second upper body projection, a portion of the first sidewall surface of the third upper body projection and that portion of the lower side surface therebetween. The ink jet print head further includes a controller having a first conductive lead electrically connected to the first layer of conductive material mounted to the first lower body projection, a second conductive lead electrically connected to the second layer of conductive material mounted to the first lower body projection and to the first layer of conductive material mounted to the second lower body projection and a third conductive lead electrically connected to the second layer of conductive material mounted to the second lower body projection. When the controller applies a first voltage to the first conductive lead and a second voltage having a negative potential with respect to the first voltage to the second conductive lead, a first electric field is produced across the first lower body projection such that the first lower body projection compresses the ink-carrying channel partially defined thereby. In one aspect of this embodiment of the invention, a third layer of conductive material is used to connect the second layer of conductive material mounted to the first lower body projection and the first layer of conductive material mounted to the second lower body projection.

In yet another embodiment, the present invention is of a drop on demand type ink jet print head which includes a lower body portion formed of an inactive material, a layer of conductive material mounted to a top surface of the lower body portion and an intermediate body portion having a lower side surface mounted to the layer of conductive material and formed from an active piezoelectric material. The intermediate body portion, which includes an upper side surface and a plurality of generally parallel spaced projections projecting vertically from the upper side surface and extending longitudinally along the lower body portion, is poled in a first direction generally parallel to the vertical extension of the projections. An upper body portion which includes a lower side surface and a plurality of generally parallel spaced projections projecting vertically from the lower side surface and extending longitudinally along the upper body portion is mated with the intermediate body portion so that the projections extending from the intermediate body portion are spaced interdigitally with the projections extending from the upper body portion in a manner such that a plurality of ink-carrying channels are formed therebetween. The ink jet print head further includes means for selectively applying an electric field across each of the intermediate body projections and in the first direction. When an electric field is applied across one of the intermediate body projections, the projection imparts a pressure pulse to the ink-carrying channel. In one aspect of this embodiment of the invention, the layer of conductive material is connected to ground and the means for selectively applying an electric field across the intermediate body projections further comprises means for selectively applying a positive voltage to each of said plurality of strips of conductive material.

BRIEF DESCRIPTION OF THE DRAWING

The present invention may be better understood, and its numerous objects, features and advantages will become apparent to those skilled in the art by reference to the accompanying drawing, in which:

FIG. 4*b* is a perspective view of the alternate embodiment illustrated in FIG. 4*a.

DETAILED DESCRIPTION OF A PREFERRED EMBODIMENT

Figure 1:
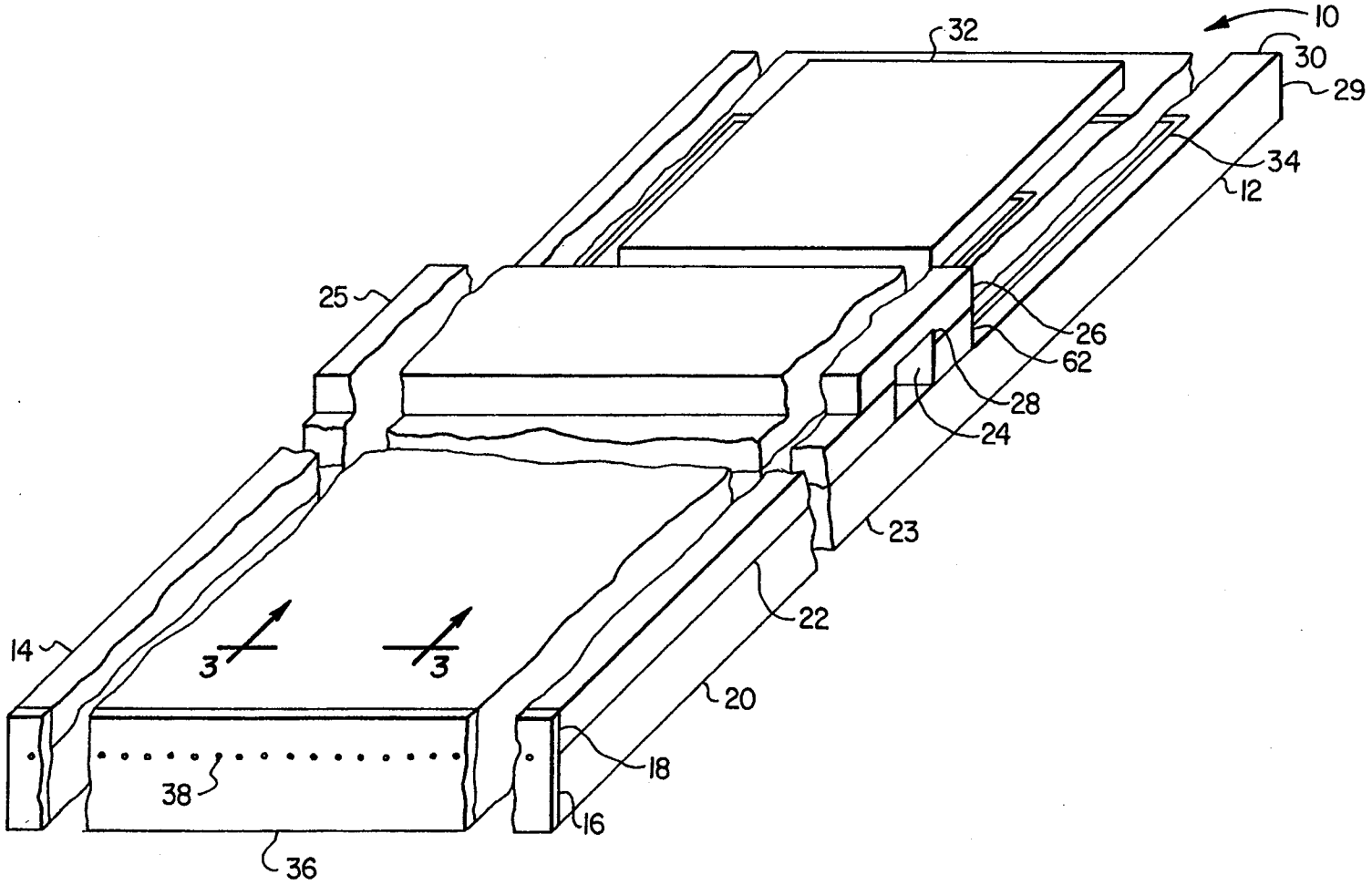
FIG. 1 is a perspective view of a schematically illustrated length mode, large array, high density, drop on demand type ink jet print head constructed in accordance with the teachings of the present invention.

Referring now to the drawing wherein thicknesses and other dimensions have been exaggerated in the various figures as deemed necessary for explanatory purposes and wherein like reference numerals designate the same or similar elements throughout the several views, in FIG. 1, a length mode, high density, large array, drop on demand type ink jet print head 10 constructed in accordance with the teachings of the present invention may now be seen. While the particular dimensions and channel density of the ink jet print head disclosed herein may be varied without departing from the scope of the invention, by "high density", it is intended to refer to those ink jet print heads in which adjacent ink-carrying channels are spaced approximately 2–8 mils apart and by "large array", it is intended to refer to those ink jet print heads having 16 or more ink-carrying channels per head.

The ink jet print head 10 includes a lower body portion 12 formed from an active piezoelectric material and an upper body portion 14 formed from an inactive material. Preferably, the lower and upper body portions 12, 14 should be similarly dimensioned along their width and height and, for reasons which will become apparent later, the lower body portion 12 should extend further along its length than the upper body portion 14. The lower and upper body portions 12, 14 are aligned along their front and side surfaces 16, 18 and 20, 22 and mated to define a series of axially extending, generally parallel ink-carrying channels (not visible in FIG. 1) therebetween. For definitional purposes, the "front section" 23 of the lower body portion 12 is that part of the lower body portion 12 which is both mated with the upper body portion 14 and in which the grooves formed therein are only metallized on the sides thereof and the "rear section" 29 of the lower body portion 12 is the groove-less, unmated part of the lower body portion 12 as well as the mated part of the lower body portion 12 in which the grooves formed therein are also metallized on the bottom thereof.

Ink is supplied to the ink-carrying channels from an ink supply of conventional design via a manifold 24 which extends across the ink jet print head 10 and is in communication with each of the ink-carrying channels. The manifold 24 is formed by cutting across the top of the upper body portion 14, thereby exposing each of the ink-carrying channels within the interior of the ink jet print head 10 and forming a horizontally extending channel. A manifold cover plate 25 is then mounted to the upper body portion 14 such that the manifold cover plate 25 extends over the horizontally extending channel to form the manifold 24. Preferably, a rear side surface 26 of the manifold cover plate 25 is aligned with a rear side surface 62 of the upper body portion 14 before mating. If desired, the volume of the manifold 24 may be increased by forming a groove 28 in the manifold cover plate 25 for alignment with the channel extending horizontally across the upper body portion 14 during the mounting process. Finally, to close the manifold 24, the end of the manifold 24 not in communication with the ink supply should be blocked, for example, by filling that end of the manifold 24 with a composite material.

Mounted to a top surface 30 of the rear section 29 of the lower body portion 12 is a controller 32, for example, a microprocessor or other integrated circuit of conventional design. Electrically connected to the controller 32 are a series of conductive leads 34, each of which extends along the top surface 30 of the lower body portion 12. Preferably, the conductive leads 34 are formed using a deposition process which forms a metallization pattern on the top surface 30 before the lower and upper body portions 12, 14 are mated. As will be more fully described below, the conductive leads 34 extend along the top surface 30 to the periphery of the ink-carrying channels where each conductive lead 34 is electrically connected such that each conductive lead 32 may control the actuation of a pair of adjacent ink-carrying channels. More specifically, the controller 32 controls the operation of the ink jet print head 10 by applying a series of positive, zero, or negative voltages to selected ones of the conductive leads 34. In response to the voltage potentials created thereby, ink-carrying channels partially defined by active piezoelectric material associated with the selected leads 34 would be compressed and/or expanded, thereby producing volumetric changes within the ink-carrying channels capable of generating acoustic pressure waves of sufficient strength to cause the ejection of a droplet of ink from the front end of the channels.

An orifice plate 36 having a plurality of orifices 38 extending therethrough is aligned and mated to the front surfaces 16, 18 of the lower and upper body portions 12, 14 such that each one of the orifices 38 is in communication with one of the ink-carrying channels longitudinally extending through the ink jet print head 10. Preferably, the orifices 38 are formed in the orifice plate 36 and the orifice plate 36 aligned with respect to the lower and upper body portions 12, 14 such that each orifice 38 is positioned in the general center of the ink-carrying channel in communication therewith. In this manner, the orifice plate 36 provides an ink ejection nozzle for each of the channels of the ink jet print head 10. It is fully contemplated, however, that the ends of each of the ink-carrying channels could effectively function as a nozzle for the ejection of droplets of ink therefrom without the necessity of providing the orifice plate 36.

Figures 2, 3A:
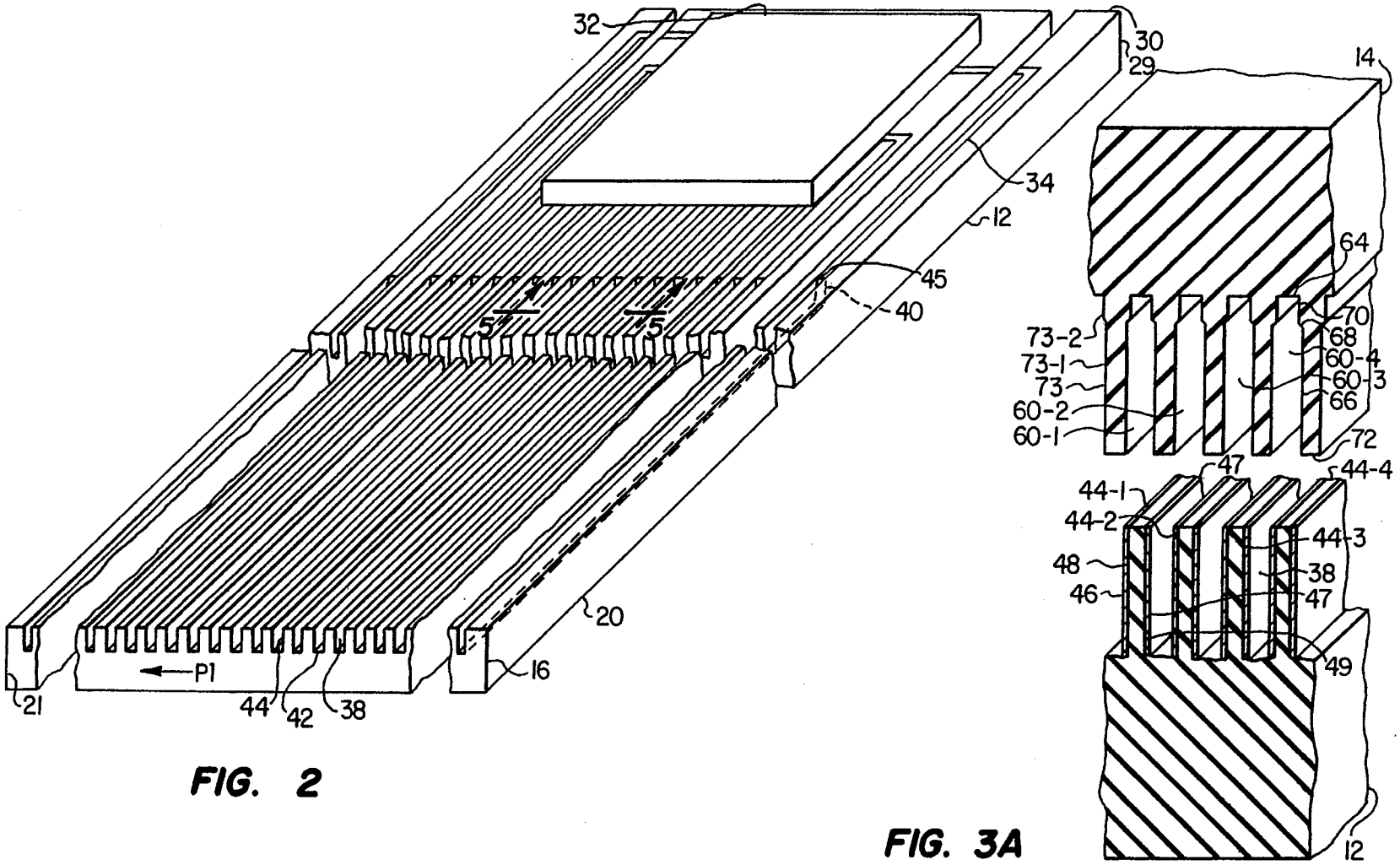
FIG. 2 is a perspective view of the ink jet print head of FIG. 1 after partial disassembly.
FIG. 3*a* is an enlarged partial cross-sectional exploded view of the ink jet print head of FIG. 1 taken along lines 3—3 thereof.

Referring next to FIG. 2, the upper body portion 14, the manifold cover 26 and the orifice plate 36 have been removed so that the projections which partially define the ink-carrying channels and the electrical connection between the active piezoelectric material which partially defines the ink-carrying channels and the controlled 32 may be more fully described. As may now be seen, the lower body portion 12 is formed of an active piezoelectric material, for example, lead zirconate titanate (or "PZT"), poled in direction P1. The lower body portion may be poled in direction P1 prior to forming grooves therein by metallizing side surfaces 20, 21, for example, using a conventional deposition process, applying a positive voltage to the side surface 20 while holding the side surface 21 to ground to polarize the lower body portion 12 and then removing the metallization. Alternately, the lower body portion 12 may be polarized after assembly of the ink jet print head 10 in a manner to be more fully described below.

Formed in the lower body portion 12 are a plurality of grooves 38 which extend from the front surface 16 to a back wall 40 located at an intermediate location along the top surface 30 of the lower body portion 12. The grooves 38, which preferably are formed substantially parallel to each other, may be formed by sawing partially through the lower body portion 12 to expose intermediate surfaces 42. Preferably, each groove 38 should be formed such that it slopes upwardly as it approaches the back wall 40 and, even more preferably, the grooves 38 should be formed such that the back wall 40 is positioned within the rear section 29 of the lower body portion 12. By forming the grooves 38 in this manner, a series of longitudinally extending projections 44 are produced. Furthermore, while it is contemplated that the ink jet print head 10 may include as many as 200 ink-carrying channels, for ease of illustration, only eighteen of grooves used to form those channels have been shown in FIG. 2.

As may be further seen in FIG. 2, each conductive lead 34 extends along the rear section 29 of the lower body portion 12 and terminates at an edge 45 of a corresponding one of the grooves 38 which extend into the lower body portion 12. There the conductive lead 34 is electrically connected to strips of conductive material which are mounted to sidewalls of the projections 44 and which have been omitted from FIG. 2 for ease of illustration but which may be seen by reference to FIG. 3A.

Figure 5:
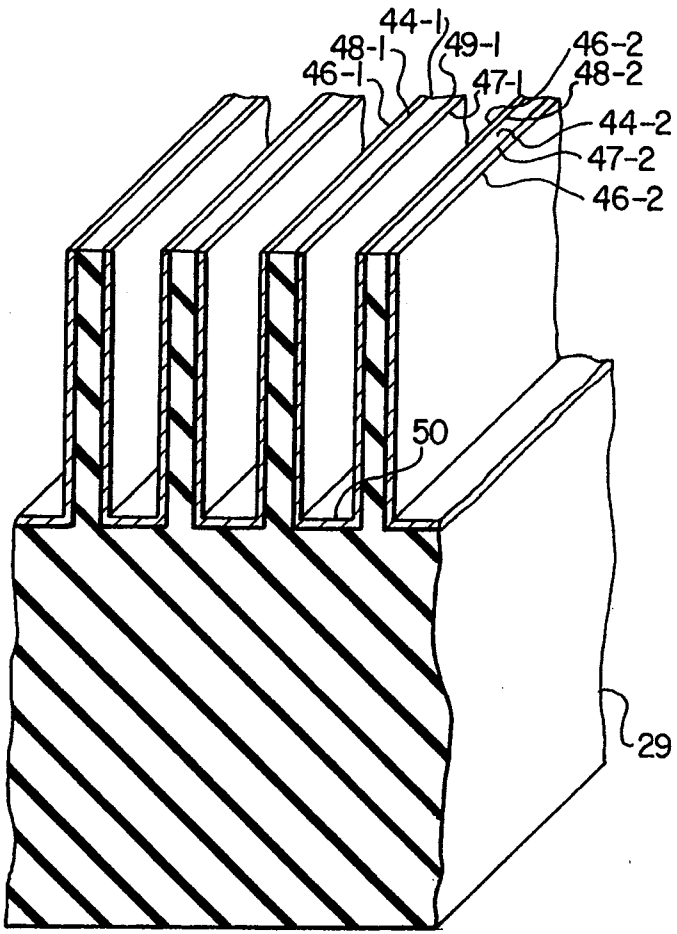
* and FIG. 5 is an enlarged partial cross-sectional view of the ink jet print head of FIG. 2 taken along lines 5—5 thereof.

As may be seen in FIG. 3A, first and second strips 46, 47, both formed from a conductive material, for example, metal, are mounted to first and second sidewalls 48, 49, respectively, of each of the projections 44 along the entire longitudinal extension thereof. For example, the strips 46, 47 may be mounted to the sidewalls 48, 49 using a conventional metallization process in which conductive material is deposited onto the sidewalls 48, 49. By adhering the conductive strips 46, 47 to the sidewalls 48, 49, of each projection 44, first and second electrical contacts are provided for each projection 44. Turning momentarily to FIG. 5, in the rear section 29 of the lower body portion 12, the grooves 38 are fully metallized. More specifically, in addition to the first and second conductive strips 46, 47, a third conductive strip 50 is mounted to the intermediate surfaces 42 between the projections 44. Again, the third conductive strip 50 may be applied using a second metallization process in the rear section 29 of the lower body portion 12 after forming the grooves 38. By providing the third conductive strip 50, the second conductive strip 47-1 mounted to the projection 44-1 is electrically connected to the first conductive strip 46-2 mounted to the projection 44-2. Thus, when the ink jet print head 10 is actuated, the conductive strips mounted to the projections 44 on opposite sides of one of the grooves 38 shall be held to a common potential. As will become more apparent later, this will produce an ink jet print head 10 in which every other ink-carrying channel may be fired simultaneously. The third strip 50 of conductive material extends along the longitudinal extension of the groove 38 in the rear section 29 and along the back wall 40 where it is electrically connected to the conductive lead 34.

Returning now to FIG. 3*a*, the upper body portion 14 shall now be described in greater detail. Like the lower body portion 12, the upper body portion 14 has a plurality of generally parallel grooves 60 which extend longitudinally from the front surface 18 to the rear side surface 62. Each groove 60 includes a first, wider, section 66 which extends from a bottom surface 72 to a notch 68 and a second, narrower, section 70 which extends from the notch 68 to a lower side surface 64. The grooves 60, which preferably are formed substantially parallel to each other, may be formed by a two step sawing process. In the first sawing step, the first groove sections 66, which should be formed to have approximately the same width and depth as the grooves 38, are formed. In the second sawing step, the second groove sections 70, which are to form the ink-carrying channels for the ink jet print head 10, are formed. By forming the grooves 60, a series of longitudinally extending upper body projections 73, each having a wider section 73-1 and a narrower section 73-2, are produced. While it is contemplated that the ink jet print head 10 should include one less groove 60 than the number of the grooves 38, for ease of illustration, only four of the grooves 60 have been shown in FIG. 3A. Furthermore, when forming the grooves 60 in the upper body portion 14, the grooves 60 should be offset by the thickness of a single groove with respect to the grooves 38 of the lower body portion 12 so that, when mating the two, the side surfaces 20, 22 will lay flush with each other.

Figure 3C:
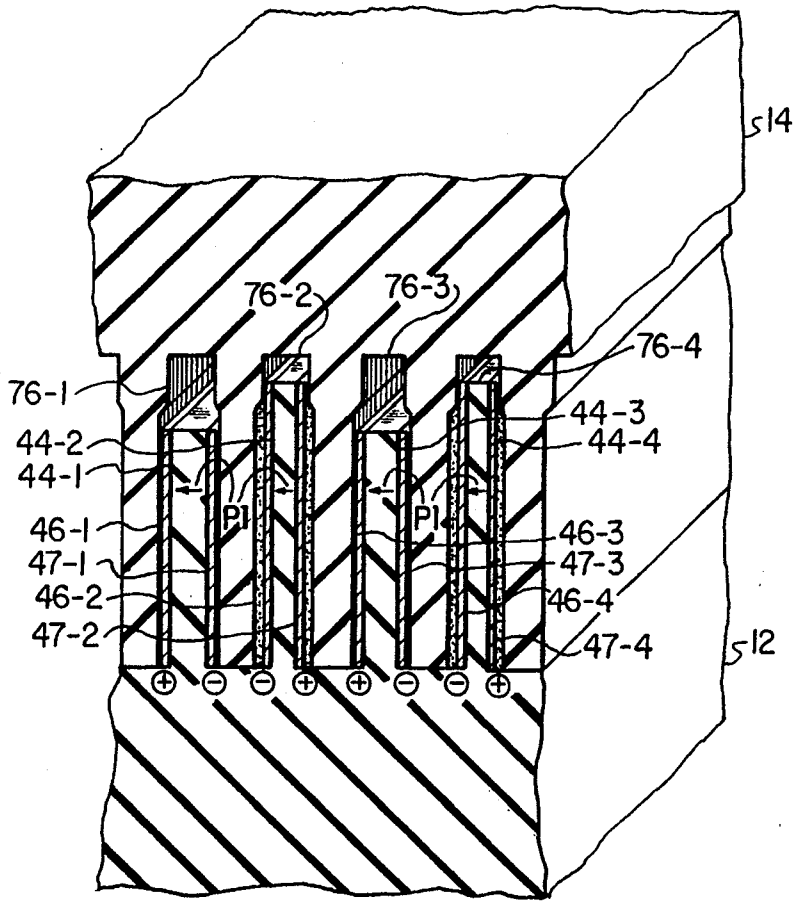
FIG. 3*c* illustrates the fully assembled ink jet print head of FIG. 3*b* after actuation.
Figure 3B:
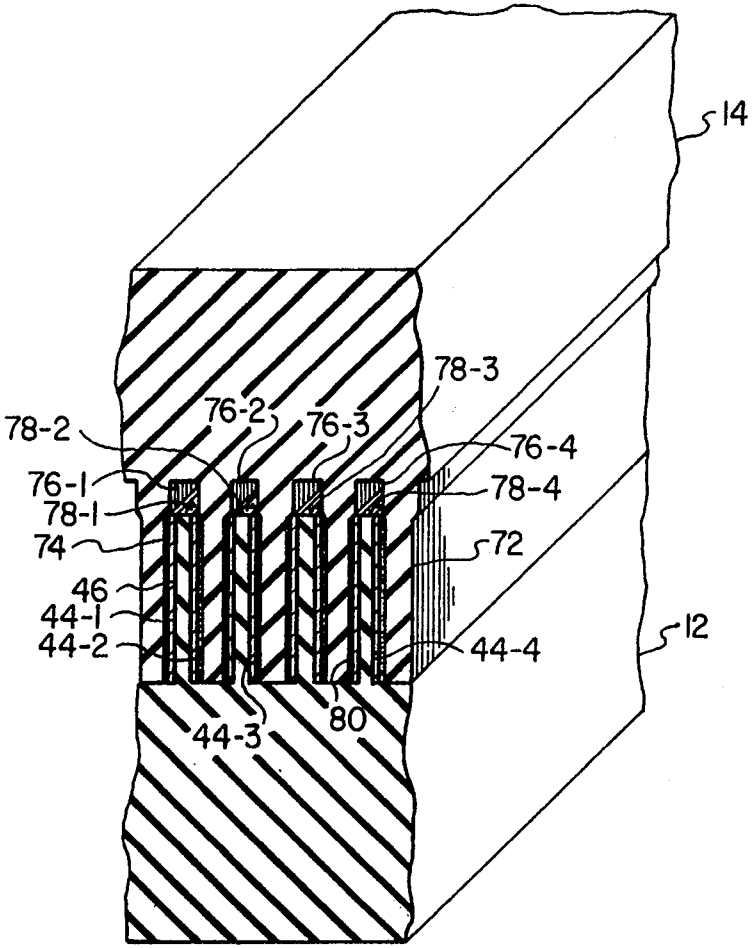
FIG. 3*b* illustrates the ink jet print head of FIG. 3*a* after assembly.

Referring next to FIG. 3*b*, the channel array formed by mating the lower and upper body portions 12, 14 may now be seen. To form the channel array, the first and second conductive strips 46-1, 46-2, 46-3, 46-4 and 47-1, 47-2, 47-3, 47-4 mounted to the sidewalls of the projections 44-1, 44-2, 44-3, 44-4 are each coated with a layer 74 of an adhesive sealant material. The projections 44-1, 44-2, 44-3, 44-4 are then inserted into the grooves 60-1, 60-2, 60-3, 60-4, respectively. As the first groove sections 66 and the projections 44-1, 44-2, 44-3, 44-4 are of approximately equal dimensions, the top surfaces 78-1, 78-2, 78-3 and 78-4 of the projections 44-1, 44-2, 44-3, 44-4 will mate with the notches 68 and the lower surfaces 80 of the projections 72 will mate with the exposed surfaces 42. By mating the lower and upper body portions 12, 14 together in the manner described herein, a series of ink-carrying channels 76-1, 76-2, 76-3, 76-4, each defined by a pair of the wider sections 70, the portion of the lower side surface 64 between the pair of wider sections 70 and top surface 78-1, 78-2, 78-3 and 78-4, respectively, are formed. Furthermore, as will be more fully described with respect to FIG. 3*b*, each of the projections 44-1, 44-2, 44-3 and 44-4 is an actuator capable of imparting acoustic pressure pulses into the respective ink-carrying channel 76-1, 76-2, 76-3 and 76-4 partially defined thereby.

Referring next to FIG. 3*c*, the actuation of the ink-carrying channels 76-1, 76-2, 76-3, 76-4 will now be described in greater detail. As previously stated, the projections 44-1, 44-2, 44-3 and 44-4 may be poled in direction P1 in the manner previously described. Alternately, the projections 44-1, 44-2, 44-3 and 44-4 may be poled after the ink jet print head 10 is fully assembled by applying voltages, each having a selected polarity and magnitude, to the strips 46-1, 47-1, 46-2, 47-2, 46-3, 47-3, 46-4, 47-4 in a configuration which will polarize the projections 44-1, 44-2, 44-3, 44-4 in the desired direction.

When a block of an active piezoelectric material such as any one of the projections 44-1, 44-2, 44-3, 44-4 is subjected to an electric field parallel to the poling direction, the block will undergo deformation, i.e. the block will expand in one axis and shrink in the other two axes. Furthermore, the direction in which the block will expand will be in either first or second directions in the expansion axis, depending on the direction of the electric field applied thereto. More specifically, when the controller applies a positive voltage to the conductive strips 46-1, 47-2, 46-3 (which, as previously stated is electrically connected to the conductive strip 47-2 to permit a single conductive lead 34 to apply both voltages) and 47-4 while either holding the conductive strips 47-1, 46-2 (which is connected to the conductive strip 47-1), 47-3 and 46-4 (which is connected to the conductive strip 47-3) to zero or applying a negative voltage thereto, the projections 44-2 and 44-4 will compress the ink-carrying channels 76-2 and 76-4, thereby imparting an acoustic pressure wave thereto which will later result in the ejection of an ink droplet therefrom. The projections 44-2 and 44-4 will generate a positive pressure wave which propagates through the ink-carrying channels 76-2, 76-4 and to the orifice 36 in communication therewith. There a droplet of ink contained within the ink-carrying channels 76-2, 76-4 will overcome the surface tension of the meniscus and be propelled through the air towards a surface (not shown) of a recording media (also not shown). The positive pressure wave will also propagate towards the manifold 24, thereby causing some of the ink in the channels 76-2, 76-4 to flow into the manifold 24. It is contemplated, however, that the relatively large volume of ink in the manifold 24 will dampen the effects of the flow of ink thereto, thereby preventing cross-talk between channels. Simultaneous with the compression of the ink-carrying channels 76-2, 76-4, the projections 44-1 and 44-3 will expand the ink-carrying channels 76-1 and 76-3, thereby generating a negative pressure wave at both ends of the ink-carrying channels 76-1, 76-3. The negative pressure wave at the back end of the ink-carrying channels 76-1, 76-3 will draw additional ink from the manifold 24 and into the channels 76-1 and 76-3 while the negative pressure wave at the front end of the ink-carrying channels 76-1, 76-3 will cause the meniscus to retract. If, on the other hand, the polarity of the applied voltages are reversed, the projections 44-1 and 44-3 will compress the ink-carrying channels 76-1 and 76-3 and the projections 44-2 and 44-4 will expand the channels 76-2 and 76-4. Finally, depending on whether the channels are contracted or expanded, the layer 74 of sealant material will also expand or contract to maintain the seal between the projections 44 and 73, thereby preventing ink from leaking from the channels.

Figure 4A:
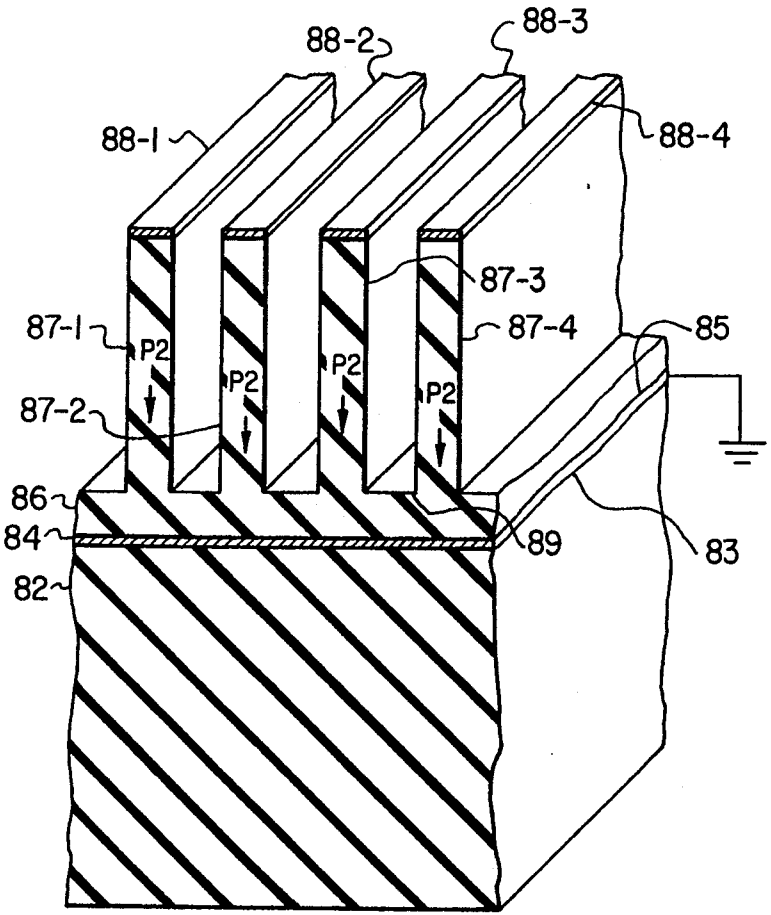
FIG. 4*a* is a cross-sectional view of an alternate embodiment of the lower body portion of the ink jet print head of FIG. 3*a;*
Figure 4B:
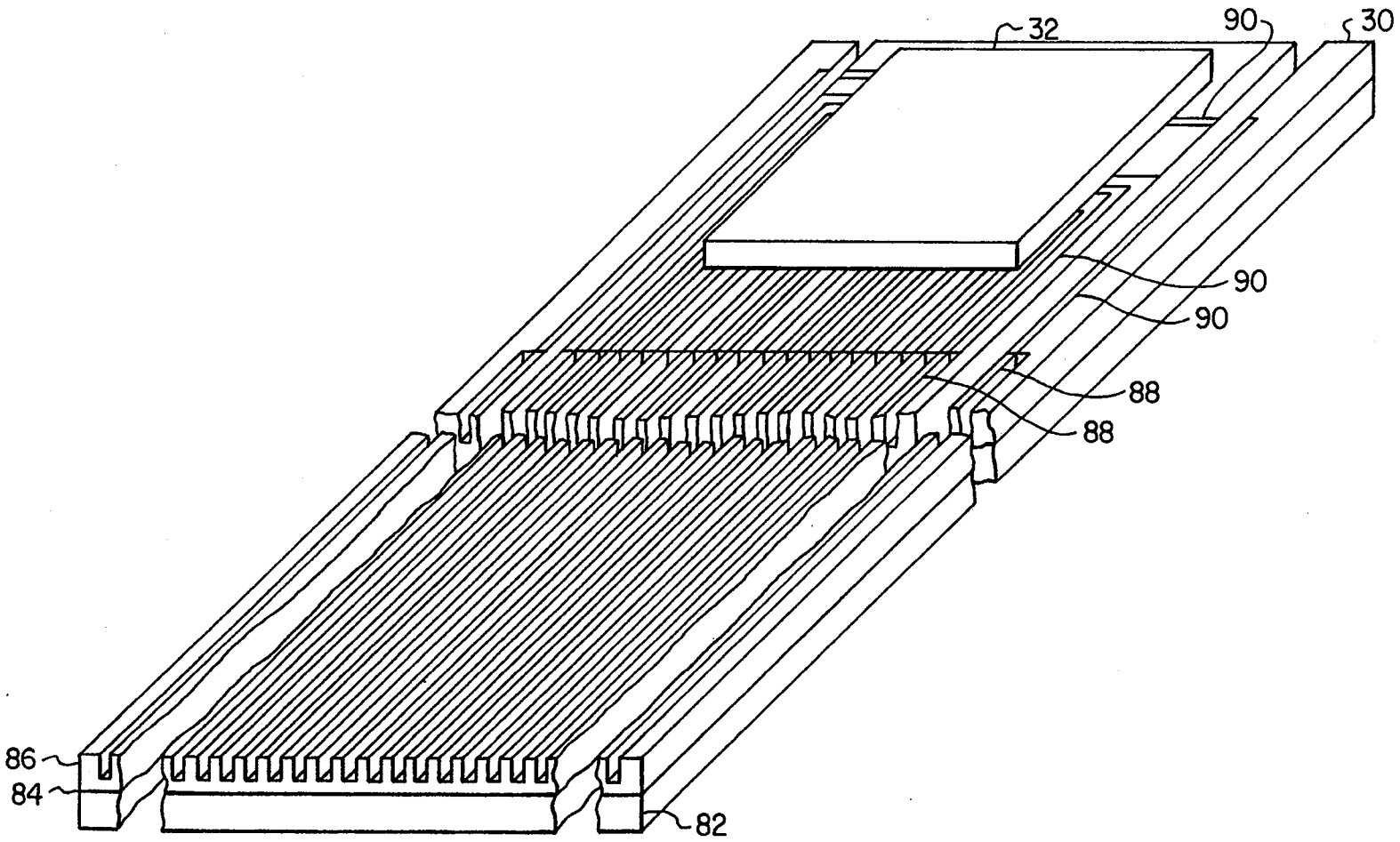

Referring next to FIGS. 4A–B, an alternate embodiment of the invention shall now be described. In this embodiment of the invention, the lower body portion 82 is a projectionless block formed using an inactive material. A layer 84 of conductive material, is mounted to a top surface of the lower body portion 82 and a bottom surface 85 of intermediate body portion 86. The intermediate body portion 86 is formed of an active piezoelectric material and includes a plurality of longitudinally extending projections 87-1, 87-2, 87-3, 87-4 vertically extending from a lower side surface 89 thereof. Mounted to the top side of each projection 87-1, 87-2, 87-3, 87-4 is a corresponding strip 88-1, 88-2, 88-3, 88-4 of conductive material. The intermediate body portion 86 may be formed in any number of ways. For example, a projectionless block of piezoelectric material poled in direction P2 and having a layer of conductive material along the top surface thereof may be mounted to the lower body portion 82. The projections 87-1 through 87-4 and the corresponding conductive strips 88-1 through 88-4 are then formed by sawing a series of grooves which extend through the layer of conductive material and part of the intermediate portion 86.

Once formed, the intermediate body portion 86 is then mated with the upper body portion 14 in a manner identical to that already described to again form a channel array for an ink jet print head. To electrically connect the ink jet print head, the conductive layer 84 is connected to ground and each of the conductive strips 88-1, 88-2, 88-3, 88-4 is electrically connected to the controller 32. Turning next to FIG. 4*a*, the electrical connection between the conductive strips 88-1, 88-2, 88-3, 88-4 and the controller 32 may now be seen. Electrically connected to the controller 32 are a series of conductive leads 90, each of which extends along the top surface 30 of the intermediate body portion 86 where it is electrically connected to one of the conductive strips 88. The controller 32 controls the operation of the ink jet print head 10 by applying a series of positive or negative voltages to selected ones of the conductive leads 90. Also, while the intermediate body section 86 can be poled in direction P2 before assembling the ink jet print head 10, the projections 87 may be poled by applying a positive voltage to each conductive strip 88 after the ink jet print head 10 has been assembled. Once fully assembled, selected ink-carrying channels partially defined by respective ones of the strips 88 of conductive material may be compressed by applying a positive voltage to the strip 88 and may be expanded by applying a negative voltage to the strip 88.

Thus, there has been described and illustrated herein, a length mode, large array, high density drop on demand type ink jet print head having uniquely configured body portions which greatly simplify the assembly process by eliminating the need for a separate actuator piece for each channel of the ink jet print head. By reducing the number of components required to assembly the print head, the present invention has made both large array and high density print heads much more feasible. However, those skilled in the art will recognize that many modifications and variations besides those specifically mentioned may be made in the techniques described herein without departing substantially from the concept of the present invention. Accordingly, it should be clearly understood that the form of the invention as described herein is exemplary only and is not intended as a limitation on the scope of the invention.

What is claimed is:

1. A length mode, drop on demand ink jet print head, comprising:

a lower body portion formed from an active piezoelectric material, said lower body portion having an upper side surface and a plurality of generally parallel spaced projections extending vertically from said upper side surface and having a first height, and extending longitudinally along said lower body portion, each of said projections having first and second sidewall surfaces and a top surface, said lower body portion being poled in a first direction generally orthogonal to both said longitudinal extension and said vertical extension of said projections;

an upper body portion formed from an inactive material, said upper body portion having a lower side surface and a plurality of generally parallel spaced projections, each of said projections extending vertically from said lower side surface and having a second height greater than said first height, extending longitudinally along said upper body portion, and having first and second sidewall surfaces;

said upper side surface of said lower body portion mated with said lower side surface of said upper body portion such that said plurality of projections extending from said lower body portion are spaced interdigitally with said plurality of projections extending from said upper body portion, each one of said projections of said lower body portion being inserted between a pair of said projections of said upper body portion, said mating of said lower body portion with said upper body portion forming a plurality of ink-carrying channels;

sealant means for forming a seal between said first and second sidewall surfaces for each of said projections of said lower body portion and a pair of projections of said upper body portion; and means for selectively applying an electric field across each of said projections of said lower body portion and in said first direction;

wherein application of an electric field across one of said projections of said lower body portion causes said projection to impart a pressure pulse to a corresponding one of said ink-carrying channels.

2. A length mode, drop on demand ink jet print head according to claim 1 wherein each one of said projections of said lower body portion is inserted between said pair of said projections of said upper body portion and wherein each one of said ink-carrying channels formed by the mating of said upper side surface of said lower body portion and said lower side surface of said upper body portion is defined by said top surface of one of said projections of said lower body portion, a portion of said first sidewall surface of a first one of said pair of projections of said upper body portion, a portion of said second sidewall surface of a second one of said pair of projections of said upper body portion and a portion of said lower side surface which is between said pair of projections of said upper body portion.

3. A length mode, drop on demand ink jet print head according to claim 2 wherein said means for selectively applying an electric field across each of said projections of said lower body portion and in said first direction further comprises:

a first layer of conductive material mounted to said first sidewall surface of each of said projections of said lower body portion;

a second layer of conductive material mounted to said second sidewall surface of each of said projections of said lower body portion; and means for selectively providing a voltage drop between said first layer of conductive material and said second layer of conductive material for each of said projections of said lower body portion;

wherein said sealant means forms a seal between said first layer of conductive material and said second layer of conductive material for each of said projections of said lower body portion and said corresponding pair of projections of said upper body portion.

4. A length mode, drop on demand ink jet print head according to claim 3 wherein said means for selectively providing a voltage drop between said first layer of conductive material and said second layer of conductive material for each of said projections of said lower body portion further comprises:

a controller having a plurality of conductive leads and means for selectively applying a positive, zero, or negative voltage to each of said leads; and means for electrically connecting each of said plurality of conductive leads to said first layer of conductive material and said second layer of conductive material for each of said projections of said lower body portion.

5. A length mode, drop on demand ink jet print head, comprising:

an upper body portion formed from an inactive material;

a lower body portion formed from an active piezoelectric material, said lower body portion having an upper side surface, a plurality of generally parallel spaced projections extending vertically from said upper side surface and surface a first height and extending longitudinally along said lower body portion, a front section mated with said upper body portion and a partially unmated rear section, each of said projections having first and second sidewall surfaces and a top surface, said lower body portion being poled in a first direction generally orthogonal to both said longitudinal extension and said vertical extension of said projections;

said upper body portion having a lower side surface and a plurality of generally parallel spaced projections, each of said projections extending vertically from said lower side surface and having a second height greater than said first height, extending longitudinally along said upper body portion, and having first and second sidewall surfaces;

said upper side surface of said lower body portion mated with said lower side surface of said upper body portion such that said plurality of projections extending from said lower body portion are spaced interdigitally with said plurality of projections extending from said upper body portion and each one of said projections of said lower body portion is inserted between a pair of said projections of said upper body portion, said mating of said lower body portion with said upper body portion forming a plurality of ink-carrying channels, each one of said ink-carrying channels formed by the mating of said upper side surface of said lower body portion and said lower side surface of said upper body portion and being defined by said top surface of one of said projections of said lower body portion, a portion of said first sidewall surface of a first one of said pair of projections of said upper body portion, a portion of said second sidewall surface of a second one of said pair of projections of said upper body portion and a portion of said lower side surface which is between said pair of projections of said upper body portion;

a first layer of conductive material mounted to said first sidewall surface of each of said projections of said lower body portion;

a second layer of conductive material mounted to said second sidewall surface of each of said projections of said lower body portion;

a third layer of conductive material connected to said upper side surface of said lower body portion in said rear section of said lower body portion, said third layer of conductive material electrically connected to said first layer of conductive material and said second layer of conductive material;

a controller having a plurality of conductive leads and means for selectively applying a positive, zero, or negative voltage to each of said leads; and means for electrically connecting each of said plurality of conductive leads to said first layer of conductive material and said second layer of conductive material for each of said projections of said lower body portion;

wherein application of an electric field across one of said projections of said lower body portion causes said projection to impart a pressure pulse to a corresponding one of said ink-carrying channels.

6. A length mode, drop on demand ink jet print head according to claim 5 further comprising sealant means for forming a seal between said first layer of conductive material and said second layer of conductive material for each of said projections of said lower body portion and said pair of projections of said upper body portion.

7. A length mode, drop on demand ink jet print head, comprising:

a lower body portion formed from an active piezoelectric material, said lower body portion having an upper side surface and a plurality of generally parallel spaced projections extending vertically from said upper side surface and extending longitudinally along said lower body portion, each of said projections having first and second sidewall surfaces and a top surface, said lower body portion being poled in a first direction generally orthogonal to both said longitudinal extension and said vertical extension of said projections;

an upper body portion formed from an inactive material, said upper body portion having a lower side surface and a plurality of generally parallel spaced projections, each of said projections extending vertically from said lower side surface, extending longitudinally along said upper body portion, and having first and second sidewall surfaces, each of said projections of said upper body portion further comprising:

a first section which extends from said lower side surface section of said upper body portion, said first section having first and second sidewall surfaces;

a notched section integrally formed with said first section, said notched section having first and second sidewall surfaces; and a second section, said second section integrally formed with said notched section, said second section being narrower than said first section and having first and second sidewall surfaces and a bottom surface;

said upper side surface of said lower body portion mated with said lower side surface of said upper body portion such that said plurality of projections extending from said lower body portion are spaced interdigitally with said plurality of projections extending from said upper body portion, the top surface of each of said projections of said lower body portion mating with the notched section of each of said projections of said upper body portion to form said ink-carrying channels;

means for selectively applying an electric field across each of said projections of said lower body portion and in said first direction;

wherein application of an electric field across one of said projections of said lower body portion causes said projection to impart a pressure pulse to a corresponding one of said ink-carrying channels.

8. A length mode, drop on demand ink jet print head according to claim 7 wherein each one of said projections of said lower body portion is inserted between a pair of said projections of said upper body portion and wherein each one of said ink-carrying channels formed by the mating of said upper side surface of said lower body portion and said lower side surface of said upper body portion is defined by said top surface of one of said projections of said lower body portion, said first sidewall surface of said first section of a first one of said pair of projections of said upper body portion, said second sidewall surface of said first section of a second one of said pair of projections of said upper body portion and a portion of said lower side surface which is between said pair of projections of said upper body portion.

9. A length mode, drop on demand ink jet print head according to claim 8 wherein said means for selectively applying an electric field across each of said projections of said lower body portion and in said first direction further comprises:

a first layer of conductive material mounted to said first sidewall surface of each of said projections of said lower body portion;

a second layer of conductive material mounted to said second sidewall surface of each of said projections of said lower body portion; and means for selectively providing a voltage drop between said first layer of conductive material and said second layer of conductive material for each of said projections of said lower body portion.

10. A length mode, drop on demand ink jet print head according to claim 9 wherein said means for selectively providing a voltage drop between said first layer of conductive material and said second layer of conductive material for each of said projections of said lower body portion further comprises:

a controller having a plurality of conductive leads and means for selectively applying a positive, zero, or negative voltage to each of said leads; and means for electrically connecting each of said plurality of conductive leads to said first layer of conductive material and said second layer of conductive material for each of said projections of said lower body portion.

11. A length mode, drop on demand ink jet print head according to claim 10 wherein said lower body portion further comprises a front section mated with said upper body portion and a partially unmated rear section and further comprising a third layer of conductive material connected to said upper side surface of said lower body portion in said rear section of said lower body portion, said third layer of conductive material electrically connected to said first layer of conductive material and said second layer of conductive material.

12. A length mode, drop on demand ink jet print head according to claim 11 further comprising sealant means for forming a seal between said first layer of conductive material and Said second lawyer of conductive material for each of said projections of said lower body portion and said pair of projections of said upper body portion.

13. A length mode, drop on demand ink jet print head, comprising:

an upper body portion formed from an inactive material;

a lower body portion formed from an active piezoelectric material, said lower body portion having an upper side surface, first and second generally parallel spaced projections extending vertically from said upper side surface and having a first height and extending longitudinally along said lower body portion, and a front section mated with said upper body portion and a partially unmated rear section, each of said first and second projections having first and second sidewall surfaces and a top surface, said lower body portion being poled in a first direction generally orthogonal to both said longitudinal extension and said vertical extension of said projections;

a first layer of conductive material mounted to said first sidewall surface of said first and second projections of said lower body portion;

a second layer of conductive material mounted to said second sidewall surface of said first and second projections of said lower body portion;

a third layer of conductive material connected to said upper side surface between said first and second projections of said lower body portion in said rear section, said third layer of conductive material electrically connected to said second layer of conductive material mounted to said first projection of said lower body portion and said first layer of conductive material mounted to said second projection of said lower body portion;

said upper body portion having a lower side surface and first, second, and third generally parallel spaced projections, each of said first, second and third projections extending vertically from said lower side surface and having a second height greater than said first height, extending longitudinally along said upper body portion, and having first and second sidewall surfaces;

said upper side surface of said lower body portion mated with said lower side surface of said upper body portion such that said first projection of said lower body portion is inserted between said first and second projections of said upper body portion to form a first ink-carrying channel defined by said top surface of said first projection of said lower body portion, a portion of said second sidewall surface of said first projection of said upper body portion, a portion of said first sidewall surface of said second projection of said upper body portion and a portion of said upper side surface between said first and second projections of said upper body portion and said second projection of said lower body portion is inserted between said second and third projections of said upper body portion to form a second ink-carrying channel defined by said top surface of said second projection of said lower body portion, a portion of said second sidewall surface of said second projection of said upper body portion, a portion of said first sidewall surface of said third projection of said upper body portion and the portion of said upper side surface between said second and third projections of said upper body portion;

a controller having first, second and third conductive leads and means for selectively applying a positive, zero, or negative voltage to each of said leads, said first conductive lead electrically connected to said first layer of conductive material mounted to said first projection of said lower body portion, said second conductive lead electrically connected to said second layer of conductive material mounted to said first projection of said lower body portion and to said first layer of conductive material mounted to said second projection of said lower body portion and said third conductive lead electrically connected to said second layer of conductive material mounted to said second projection of said lower body portion;

wherein said controller applies a first voltage to said first conductive lead and a second voltage having a negative potential with respect to said first voltage to said second conductive lead, thereby producing a first electric field across said first projection of said lower body portion, said first projection of said lower body portion compressing said first ink-carrying channel partially defined thereby to impart an acoustic pressure pulse capable of ejecting a droplet of ink therefrom.

14. A length mode, drop on demand ink jet print head according to claim 13 further comprising sealant means for forming a seal between said first layer of conductive material mounted to said first side surface of said first projection said lower body portion and said second layer of conductive material mounted to said second side surface of said first projection of said upper body portion, between said second layer of conductive material mounted to said second side surface of said first projection of said lower body portion and said first layer of conductive material mounted to said first side surface of said second projection of said upper body portion, between said first layer of conductive material mounted to said first side surface of said second projection of said lower body portion and said second layer of conductive material mounted to said second side surface of said second projection of said upper body portion and between said second layer of conductive material mounted to said second side surface of said second projection of said lower body portion and said first layer of conductive material mounted to said first side surface of said third projection of said upper body portion.

15. A drop on demand ink jet print head, comprising:

a lower body portion having a top side surface, said lower body portion formed from an inactive material;

an intermediate body portion having a lower side surface, an upper side surface and a plurality of projections extending vertically from said upper side surface and having a first height, extending longitudinally along said intermediate body portion and each having a top surface, said intermediate body portion formed from an active piezoelectric material poled in a first direction parallel to the vertical extension of said projections;

a layer of conductive material mounted to said top side surface of said lower body portion and said lower side surface of said intermediate body portion;

a strip of conductive material mounted to said top surface of each of said plurality of intermediate body portions;

an upper body portion formed from an inactive material, said upper body portion having a lower side surface and a plurality of generally parallel spaced projections, each of said projections vertically projecting from said lower side surface and having a second height greater than said first height, extending longitudinally along said upper body portion and having a bottom surface;

said upper side surface of said intermediate body portion mated with said lower side surface of said upper body portion such that said plurality of projections extending from said intermediate body portion are spaced interdigitally with said plurality of projections extending from said upper body portion, each one of said projections of said intermediate body portion being inserted between a pair of said projections of said upper body portion, said mating of said intermediate body portion and said upper body portion forming a plurality of ink-carrying channels; and means for selectively applying an electric field across each of said projections of said intermediate body portion and in said first direction;

wherein application of an electric field across one of said projections of said intermediate body portion and in said first direction causes said projection to impart a pressure pulse to said ink-carrying channels.

16. A drop on demand ink jet print head according to claim 15 wherein said layer of conductive material is connected to ground and wherein said means for selectively applying an electric field across each of said projections of said intermediate body portion further comprises means for selectively applying a positive voltage to said strip of conductive material mounted to said top surface of each of said plurality of intermediate body portions.

17. A drop on demand ink jet print head according to claim 16 further comprising:

a controller having a plurality of conductive leads and means for selectively applying a positive voltage to each of said leads; and means for electrically connecting each of said plurality of conductive leads to a corresponding one of each said strip of conductive material.

18. A drop on demand ink jet print head according to claim 17 wherein each of said projections of said upper body portion further comprises:

a first section which extends from said lower side surface of said upper body portion, said first section having first and second sidewall surfaces;

a notched section integrally formed with said first section, said notched section having first and second sidewall surfaces; and a second section, said second section integrally formed with said notched section, said second section being narrower than said first section and having first and second sidewall surfaces and a bottom surface;

wherein the top surface of each of said projections of said lower body portion mate with the notched section of each of said projections of said upper body portion to form said ink-carrying channels.

19. A drop on demand ink jet print head according to claim 18 wherein each one of said projections of said intermediate body portion is inserted between a pair of said projections of said upper body portion and wherein each one of said ink-carrying channels formed by the mating of said intermediate and upper body portions is defined by said strip of conductive material mounted to said top surface of one of said projections, said first sidewall surface of said first section of a first one of said pair of projections of said upper body portion, said second sidewall surface of said first section of a second one of said pair of projections of said upper body portion and a portion of said lower side surface between said pair of projections of said upper body portion.

20. A drop on demand ink jet print head according to claim 19 wherein each of said plurality of projections of said intermediate body portion further comprise first and second sidewalls and further comprising sealant means for forming a seal between said sidewalls of said projections of said intermediate body portions and said sidewalls of said second sections of said corresponding pair of projections of said upper body portion.

21. A length mode, drop on demand ink jet print head, comprising:

an upper body portion formed from an inactive material, a lower body portion formed from an active piezoelectric material, said lower body portion having an upper side surface, a plurality of generally parallel spaced projections extending vertically from said upper side surface and having a first height and extending longitudinally along said lower body portion, a front section mated with said upper body portion and a partially unmated rear section, each of said projections having first and second sidewall surfaces and a top surface, said lower body portion being poled in a first direction generally orthogonal to both said longitudinal extension and said vertical extension of said projections;

said upper body portion having a lower side surface and a plurality of generally parallel spaced projections, each of said projections extending vertically from said lower side surface and having a second height greater than said first height, extending longitudinally along said upper body portion, and having first and second sidewall surfaces;

said upper side surface of said lower body portion mated with said lower side surface of said upper body portion such that said plurality of projections extending from said lower body portion are spaced interdigitally with said plurality of projections extending from said upper body portion, each one of said projections of said lower body portion being inserted between a pair of said projections of said upper body portion, said mating of said lower body portion with said upper body portion forming a plurality of ink-carrying channels;

a first layer of conductive material mounted to said first sidewall surface of each of said projections of said lower body portion;

a second layer of conductive material mounted to said second sidewall surface of each of said projections of said lower body portion;

a third layer of conductive material connected to said upper side surface of said lower body portion in said rear section of said lower body portion, said third layer of conductive material electrically connected to said first layer of conductive material and said second layer of conductive material; and means for selectively providing a voltage drop between said first layer of conductive material and said second layer of conductive material for each of said projections of said lower body portion;

wherein application of an electric field across one of said projections of said lower body portion causes said projection to impart a pressure pulse to a corresponding one of said ink-carrying channels.

22. A length mode, drop on demand ink jet print head, comprising:

a lower body portion formed from an active piezoelectric material, said lower body portion having an upper side surface and a plurality of generally parallel spaced projections extending vertically from said upper side surface and having a first height and extending longitudinally along said lower body portion, each of said projections having first and second sidewall surfaces and a top surface, said lower body portion being poled in a first direction generally orthogonal to both said longitudinal extension and said vertical extension of said projections;

an upper body portion formed from an inactive material, said upper body portion having a lower side surface and a plurality of generally parallel spaced projections, each of said projections extending vertically from said lower side surface and having a second height greater than said first height, extending longitudinally along said upper body portion, and having first and second sidewall surfaces;

said upper side surface of said lower body portion mated with said lower side surface of said upper body portion such that said side surfaces of said plurality of projections extending from said lower body portion are interdigitally engaged with said side surfaces of said plurality of projections extending from said upper body portion, said mating of said lower body portion with said upper body portion forming a plurality of ink-carrying channels; and means for selectively applying an electric field across each of said projections of said lower body portion and in said first direction;

wherein application of an electric field across one of said projections of said lower body portion causes said projection to impart a pressure pulse to a corresponding one of said ink-carrying channels.

23. A length mode, drop on demand ink jet print head, comprising:

a lower body portion formed from an active piezoelectric material, said lower body portion having an upper side surface and a plurality of generally parallel spaced projections extending vertically from said upper side surface and having a first height and extending longitudinally along said lower body portion, each of said projections having first and second sidewall surfaces and a top surface, said lower body portion being poled in a first direction generally orthogonal to both said longitudinal extension and said vertical extension of said projections;

an upper body portion formed from an inactive material, said upper body portion having a lower side surface and a plurality of generally parallel spaced projections, each of said projections extending vertically from said lower side surface a second height greater than said first height, extending longitudinally along said upper body portion, and having first and second sidewall surfaces;

said upper side surface and having of said lower body portion mated with said lower side surface of said upper body portion such that said first sidewall surfaces of said plurality of projections extending from said lower body portion are interdigitally engaged with said second sidewall surfaces of said plurality of projections extending from said upper body portion and said second sidewall surfaces of said plurality of projections extending from said lower body portion are interdigitally engaged with said first sidewall surfaces of said plurality of projections extending from said upper body portion;

said mating of said lower body portion with said upper body portion forming a plurality of ink-carrying channels, each one of said ink-carrying channels formed by the mating of said upper side surface of said lower body portion and said lower side surface of said upper body portion and being defined by said top surface of one of said projections of said lower body portion, a portion of said second sidewall surface of a first one of a pair of projections of said upper body portion, a portion of said first sidewall surface of a second one of said pair of projections of said upper body portion and a portion of said lower side surface which is between said pair of projections of said upper body portion;

each of said projections of said lower body portion which partially defines one of said ink-carrying channels providing a normal mode actuator for said ink-carrying channel partially defined thereby; and means for selectively applying an electric field across each of said projections of said lower body portion and in said first direction;

wherein application of an electric field across one of said projections of said lower body portion causes a normal mode deflection of said projection into said ink-carrying channels partially defined thereby.

24. A length mode drop on demand ink jet printhead according to claim 23 and further comprising sealant means for forming a seal between said first sidewall surface for each of said projections of said lower body portion and said second sidewall surface of said first one of said pair of projections of said upper body portion and between said second sidewall surface for each of said projections of said lower body portion and said first sidewall surface of said second one of said pair of projections of said upper body portion.

25. A length mode drop on demand ink jet printhead according to claim 23 and further comprising:

a first layer of conductive material mounted to said first sidewall surface of each of said projections of said lower body portion; and a second layer of conductive material mounted to said second sidewall surface of each of said projections of said lower body portion.

26. A length mode drop on demand ink jet printhead according to claim 25 and further comprising sealant means for forming a seal between said first layer of conductive material mounted to said first sidewall surface for each of said projections of said lower body portion and said second sidewall surface of said first one of said pair of projections of said upper body portion and for forming a seal between said second layer of conductive material mounted to said second sidewall surface for each of said projections of said lower body portion and said first sidewall surface of said second one of said pair of projections of said upper body portion.

* * * * *